US010622126B2

(12) United States Patent
Yamamoto

(10) Patent No.: US 10,622,126 B2
(45) Date of Patent: Apr. 14, 2020

(54) METAL MAGNETIC MATERIAL AND ELECTRONIC COMPONENT

(71) Applicant: TOKO, INC., Tsurugashima-shi (JP)

(72) Inventor: Makoto Yamamoto, Tsurugashima (JP)

(73) Assignee: Murata Manufacturing Co., Ltd., Nagaokakyo-Shi (JP)

( * ) Notice: Subject to any disclaimer, the term of this patent is extended or adjusted under 35 U.S.C. 154(b) by 0 days.

(21) Appl. No.: 15/304,734

(22) PCT Filed: Apr. 17, 2015

(86) PCT No.: PCT/JP2015/061890
§ 371 (c)(1),
(2) Date: Oct. 17, 2016

(87) PCT Pub. No.: WO2015/159981
PCT Pub. Date: Oct. 22, 2015

(65) Prior Publication Data

US 2017/0040093 A1 Feb. 9, 2017

(30) Foreign Application Priority Data

Apr. 18, 2014 (JP) ..... 2014-086178
Apr. 18, 2014 (JP) ..... 2014-086179

(51) Int. Cl.
*H01F 27/24* (2006.01)
*H01F 1/03* (2006.01)
(Continued)

(52) U.S. Cl.
CPC ..... *H01F 1/0306* (2013.01); *B22F 1/00* (2013.01); *B22F 1/0003* (2013.01); *B22F 1/02* (2013.01);
(Continued)

(58) Field of Classification Search
CPC ..... H01F 1/0306
See application file for complete search history.

(56) References Cited

U.S. PATENT DOCUMENTS

2008/0157912 A1* 7/2008 Tung ..... H01F 17/04 336/200
2010/0323206 A1 12/2010 Soma et al.
(Continued)

FOREIGN PATENT DOCUMENTS

CN 104282406 1/2015
JP 2002-256304 9/2002
(Continued)

OTHER PUBLICATIONS

English translation of JP2004224826.*

*Primary Examiner* — Ronald Hinson
(74) *Attorney, Agent, or Firm* — Cozen O'Connor

(57) ABSTRACT

Provided are: a metal magnetic material capable of reliably establishing insulation while realizing high saturation magnetic flux density; and an electronic component using the metal magnetic material and having low loss and good DC superimposition characteristics. The metal magnetic material for forming a component body of the electronic component comprises a metal magnetic alloy powder consisting of iron and silicon or containing iron, silicon and chromium; and an additional element added to the metal magnetic alloy powder, wherein the additional element is more easily oxidizable in the equilibrium state of oxidation-reduction reaction than the elements contained in the metal magnetic alloy powder. The component body (11) is internally formed with a coil pattern consisting of a plurality of coil conductor patterns (12A to 12C). The metal magnetic material is less likely to undergo degradation in magnetic properties even after it is subjected to a heat treatment at a high temperature,
(Continued)

so that it becomes possible to perform a heat treatment for reducing a resistance of the coil pattern, at an adequate temperature.

12 Claims, 8 Drawing Sheets

(51) Int. Cl.

| | |
|---|---|
| ***B22F 1/02*** | (2006.01) |
| ***H01F 27/255*** | (2006.01) |
| ***B22F 1/00*** | (2006.01) |
| ***H01F 1/33*** | (2006.01) |
| ***H01F 1/24*** | (2006.01) |
| ***C21D 6/00*** | (2006.01) |
| ***C22C 38/00*** | (2006.01) |
| ***C22C 38/02*** | (2006.01) |
| ***C22C 38/18*** | (2006.01) |

(52) U.S. Cl.
CPC ..... *C21D 6/002* (2013.01); *C21D 6/008* (2013.01); *C22C 38/002* (2013.01); *C22C 38/02* (2013.01); *C22C 38/18* (2013.01); *H01F 1/24* (2013.01); *H01F 1/33* (2013.01); *H01F 27/255* (2013.01); *B22F 2302/45* (2013.01)

(56) References Cited

U.S. PATENT DOCUMENTS

| | | | | |
|---|---|---|---|---|
| 2011/0267167 | A1 | 11/2011 | Hideki et al. | |
| 2012/0038449 | A1 | 2/2012 | Hideki et al. | |
| 2012/0119871 | A1 | 5/2012 | Hideki et al. | |
| 2012/0274437 | A1 | 11/2012 | Matsuura et al. | |
| 2012/0274438 | A1 | 11/2012 | Hachiya et al. | |
| 2013/0033354 | A1 | 2/2013 | An et al. | |
| 2013/0200970 | A1 | 8/2013 | Hideki et al. | |
| 2014/0049348 | A1 | 2/2014 | Matsuura et al. | |
| 2014/0132383 | A1 | 5/2014 | Matsuura et al. | |
| 2014/0139311 | A1 | 5/2014 | Matsuura et al. | |
| 2014/0225703 | A1 | 8/2014 | Otake et al. | |
| 2014/0239219 | A1 | 8/2014 | An et al. | |
| 2014/0240078 | A1 | 8/2014 | An et al. | |
| 2015/0099115 | A1* | 4/2015 | Maeda ..... | H01F 1/24 428/370 |
| 2016/0163448 | A1 | 6/2016 | Matsuura et al. | |

FOREIGN PATENT DOCUMENTS

| | | |
|---|---|---|
| JP | 2003-37018 | 2/2003 |
| JP | 2009-206483 | 9/2009 |
| JP | 2010-62424 | 3/2010 |
| JP | 4866971 | 11/2011 |
| JP | 4906972 | 1/2012 |
| JP | 5082002 | 9/2012 |
| JP | 2012-238841 | 12/2012 |
| JP | 2013-33966 | 2/2013 |
| WO | WO/2014/024976 | 2/2014 |

* cited by examiner

FIG.3

| | Addition amount of $Li_2CO_3$ (wt%) | Density after burning (g/cm$^3$) | μ' (@ 10MHz) | Resistivity (Ω · cm) | Three-point bending strength (MPa) | Evaluation |
|---|---|---|---|---|---|---|
| Comparative Example 1 | 0 | 5.66 | 28.37 | 1.67E+06 | 34.04 | – |
| Example 1 | 0.1 | 5.67 | 28.34 | 3.95E+07 | 54.96 | ○ |
| Example 2 | 0.2 | 5.62 | 27.46 | 5.21E+07 | 65.03 | ○ |
| Example 3 | 0.3 | 5.64 | 27.08 | 2.98E+07 | 70.36 | ○ |
| Example 4 | 0.5 | 5.73 | 26.84 | 1.01E+07 | 80.39 | ○ |
| Comparative Example 2 | 1 | 5.65 | 23.79 | 6.59E+06 | 65.51 | × |
| Comparative Example 3 | 2 | 5.61 | 23.32 | 2.72E+06 | 48.92 | × |
| Comparative Example 4 | 5 | 5.41 | 18.73 | 7.65E+05 | 31.84 | × |
| Comparative Example 5 | 10 | 4.40 | 6.09 | OL | – | × |

FIG.6

| | Composition | Addition amount of $Li_2CO_3$ (wt%) | μ' (@ 10MHz) | Resistivity (Ω · cm) | Withstand voltage (V/mm) | Three-point bending strength (MPa) | Evaluation |
|---|---|---|---|---|---|---|---|
| Comparative Example 6 | Fe-Si | 0 | 16.32 | 4.91E+08 | 600 | 37.8 | × |
| Comparative Example 1 | Fe-Si-Cr | 0 | 28.37 | 1.67E+06 | 86 | 34.0 | × |
| Example 5 | Fe-Si | 0.3 | 21.10 | 4.11E+07 | 354 | 63.5 | ○ |
| Example 6 | | 0.5 | 21.84 | 3.71E+07 | 356 | 52.9 | ○ |
| Example 7 | | 1 | 26.75 | 3.53E+07 | 598 | 58.9 | ○ |
| Example 8 | | 1.25 | 26.50 | 1.28E+07 | 494 | 94.3 | ○ |
| Example 9 | | 1.5 | 27.96 | 1.13E+07 | 541 | 115.6 | ○ |
| Example 10 | | 1.75 | 26.81 | 1.55E+07 | 434 | 213.3 | ○ |
| Example 11 | | 2 | 25.55 | 2.82E+07 | 424 | 231.3 | ○ |
| Comparative Example 7 | | 3 | 5.08 | OL | Unmeasurable | – | × |
| Comparative Example 8 | | 5 | 1.72 | OL | Unmeasurable | – | × |

FIG.8
(A)
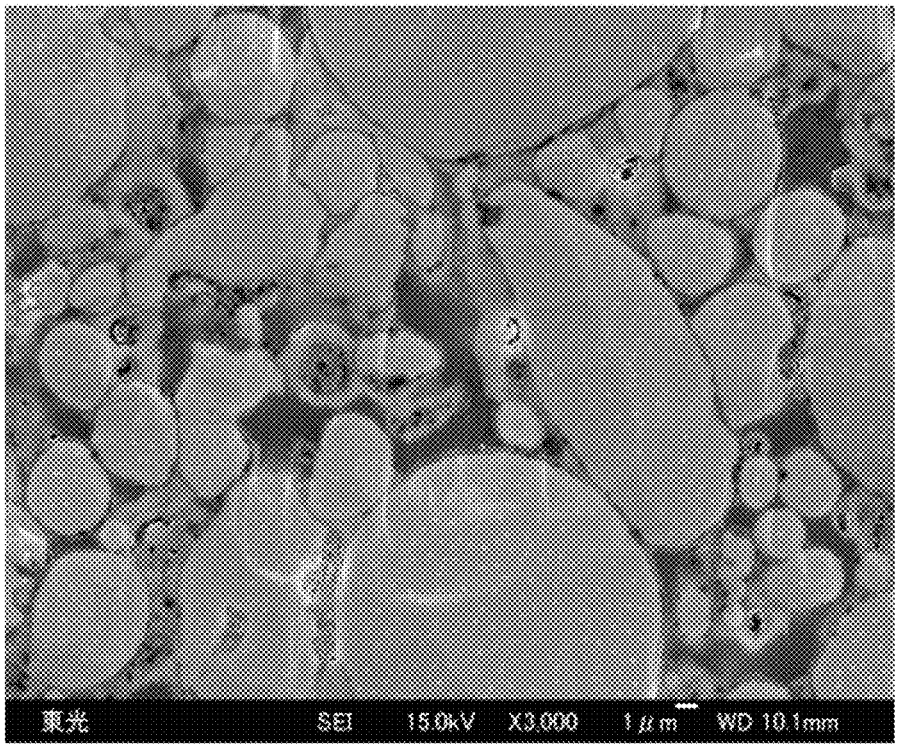
(B)
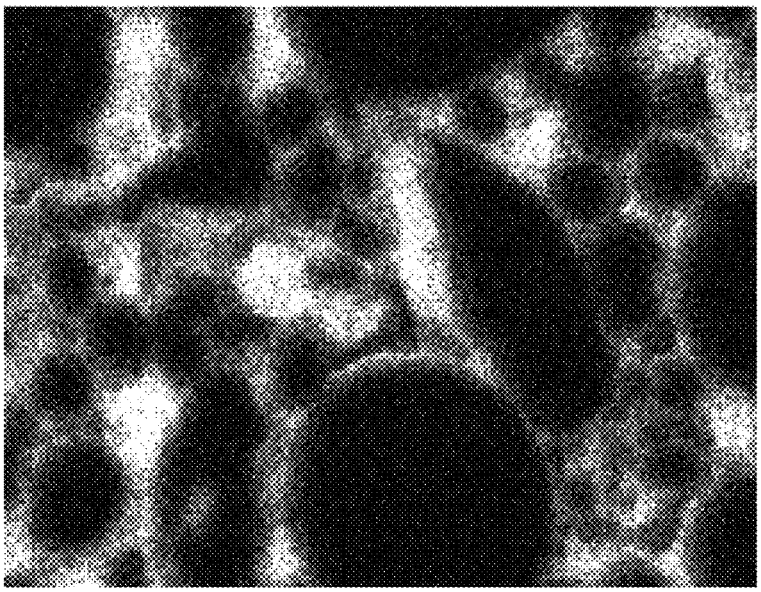
Oxygen _WD

METAL MAGNETIC MATERIAL AND ELECTRONIC COMPONENT

RELATED APPLICATIONS

This is a U.S. National Phase Application under 35 USC 371 of International Application PCT/JP2015/061890 filed on Apr. 17, 2015.

This application claims the priority of Japanese application nos. 2014-086178 filed Apr. 18, 2014, and 2014-086179 filed Apr. 18, 2014, the entire content of all of which are hereby incorporated by reference.

TECHNICAL FIELD

The present invention relates to a metal magnetic material usable for a power inductor or other component for use in an electric circuit.

BACKGROUND ART

A power inductor for use in a power supply circuit is required to achieve smaller size and lower loss and cope with a large current. With a view to meeting such requirements, it is being studied to use, as a magnetic material for the power inductor, a metal magnetic material having a high saturation magnetic flux density. Although the metal magnetic material has an advantage of exhibiting a high saturation magnetic flux density, an insulation resistance of the material itself is insufficiently low. Thus, as a prerequisite for allowing the metal magnetic material to be used as a magnetic material for an electric component, it is necessary to ensure insulation between particles of the metal magnetic material. If it fails to ensure the insulation, a component body of the electric component is electrically conducted to surroundings, or material properties of the metal magnetic material are degraded, thereby leading to an increase in loss in an end product.

Therefore, in order to allow the metal magnetic material to be used for an electric component, the insulation between particles of the metal magnetic material has heretofore been ensured by bonding the particles together by a resin or the like or by coating each of the particles with an insulating film.

For example, JP 2010-062424A describes an electronic component obtained by coating a surface of a Fe—Cr—Si alloy with ZnO-based glass to prepare a metal magnetic material, and subjecting the material to burning in a vacuum or oxygen-free or low-oxygen partial pressure atmosphere. However, the burning in a vacuum or oxygen-free or low-oxygen partial pressure atmosphere gives rise to a need to ensure coating of particles of the metal magnetic material so as to prevent sintering. This leads to problems such as a need to increase an addition amount of the glass, and an increase in cost for coating the particles.

As above, the conventional technique of bonding the particles together by a resin or the like or coating each of the particles with an insulating film has a problem that the amount of an insulating material other than the metal magnetic material has to be increased so as to more reliably ensure insulation performance, and the increase in volume of a material other than the metal magnetic material leads to degradation in magnetic properties.

There has also been disclosed a technique of forming a layer of an oxide originating from only a raw material composition of particles of a metal magnetic material, on each of the particles (JP 4866971B and JP 5082002B). In this technique, an insulation film made of an oxide originating from only the raw material composition of the particles of the metal magnetic material is utilized for insulation between the particles, so that degradation in magnetic properties becomes reduced. However, in some cases, such an insulating film made of an oxide originating from only a raw material composition of particles of a metal magnetic material, as used in the above technique, exhibits poor insulation performance or fails to obtain sufficient strength.

Therefore, there has also been disclosed a technique of forming a layer of an oxide originating from only a raw material composition of particles of a metal magnetic material, on each of the particles, and then impregnating the layer with a resin (JP 2012-238841A). However, the technique based on the impregnation or the like is poor in practicality because it causes not only an increase in cost but also a lack of stability in product quality.

Further, JP 2013-033966A discloses a magnetic layer material containing: metal magnetic particles each having a core-shell structure in which a core is made of an iron-based compound, and a shell made of a metal compound is formed around the core; and glass. However, this technique is required to coat the core-forming material with the shell-forming material so as to construct the core-shell structure. Thus, as with the aforementioned conventional technique of coating each particle with an insulating film, there are problems such as an increase in cost, and an increase in amount of a coating material (shell-forming material), leading to degradation in magnetic properties.

In the metal magnetic material for an electronic component, particles thereof need to be mutually insulated by a minimum insulating layer, so as to ensure high insulation performance. Further, the insulating film needs to be strong electrically and mechanically. Furthermore, a composition in each particle of the metal magnetic material needs to be maintained uniformly. However, each of the conventional techniques has some sort of problem, as mentioned above.

SUMMARY OF INVENTION

The present invention address a technical problem of providing a metal magnetic material capable of reliably establishing insulation while realizing high saturation magnetic flux density, and an electronic component using the metal magnetic material and having low loss and good DC superimposition characteristics.

The present invention provides the following solutions to the above technical problem.

According to a first aspect of the present invention, there is provided a metal magnetic material comprising a metal magnetic alloy powder containing iron and silicon, and an additional element added to the metal magnetic alloy powder, wherein the additional element is more easily oxidizable in an equilibrium state of oxidation-reduction reaction than the elements contained in the metal magnetic alloy powder.

In the metal magnetic material of the present invention, the metal magnetic alloy powder may further contain chromium.

In the metal magnetic material of the present invention, the metal magnetic alloy powder may consist of iron and silicon.

In the metal magnetic material of the present invention, the additional element which is more easily oxidizable in an equilibrium state of oxidation-reduction reaction than the elements contained in the metal magnetic alloy powder may be lithium.

The metal magnetic material of the present invention may be subjected to a heat treatment, wherein the metal magnetic material after the heat treatment may include a reaction product of the metal magnetic alloy powder and the additional element which is more easily oxidizable in an equilibrium state of oxidation-reduction reaction than the elements contained in the metal magnetic alloy powder.

In this case, an oxide of the elements of the metal magnetic alloy powder and the reaction product may be present.

The reaction product may be present in a vicinity of surfaces of particles of the metal magnetic alloy powder.

The reaction product may be spinel-type ferrite.

According to a second aspect of the present invention, there is provided an electric component which comprises: a component body formed using a metal magnetic material; and a coil formed inside or on a surface of the component body, wherein the metal magnetic material comprises a metal magnetic alloy powder containing iron and silicon, and an additional element added to the metal magnetic alloy powder, wherein the additional element is more easily oxidizable in an equilibrium state of oxidation-reduction reaction than the elements contained in the metal magnetic alloy powder, and wherein the component body internally includes a reaction product of the metal magnetic alloy powder and the additional element which is more easily oxidizable in an equilibrium state of oxidation-reduction reaction than the elements contained in the metal magnetic alloy powder.

In the electric component of the present invention, the metal magnetic alloy powder may further contain chromium.

In the electric component of the present invention, the metal magnetic alloy powder may consist of iron and silicon.

In the electric component of the present invention, the additional element which is more easily oxidizable in an equilibrium state of oxidation-reduction reaction than the elements contained in the metal magnetic alloy powder may be lithium.

In the electric component of the present invention, the reaction product may be deposited in a vicinity of surfaces of particles of the metal magnetic alloy powder.

In the electric component of the present invention, the reaction product may be formed by subjecting the component body to a heat treatment.

In the electric component of the present invention, particles of the metal magnetic alloy powder contained in the component body may be bound together through the reaction product of the metal magnetic alloy powder and the additional element which is more easily oxidizable in an equilibrium state of oxidation-reduction reaction than the elements contained in the metal magnetic alloy powder.

In the electric component of the present invention, adjacent particles of the metal magnetic alloy powder contained in the component body may be bound together through the reaction product of the metal magnetic alloy powder and the additional element which is more easily oxidizable in an equilibrium state of oxidation-reduction reaction than the elements contained in the metal magnetic alloy powder.

The electric component of the present invention may have: a region where adjacent particles of the metal magnetic alloy powder contained in the component body are bound together through the reaction product of the metal magnetic alloy powder and the additional element which is more easily oxidizable in an equilibrium state of oxidation-reduction reaction than the elements contained in the metal magnetic alloy powder; and a region wherein particles of the metal magnetic alloy powder contained in the component body are mutually bound together.

In the electric component of the present invention, the reaction product may be spinel-type ferrite.

In the electric component of the present invention, the component body may have a volume resistivity of $10^7$ Ω·cm or more.

In the electric component of the present invention, the component body may have a three-point bending strength of 40 MPa or more.

In the first aspect of the present invention, an additional element is added to a metal magnetic alloy powder consisting of iron and silicon or containing iron, silicon and chromium, wherein the additional element is more easily oxidizable in an equilibrium state of oxidation-reduction reaction than the elements contained in the metal magnetic alloy powder. This makes it possible to allow a metal magnetic material to reliably establish insulation while realizing high saturation magnetic flux density.

In the second aspect of the present invention, a component body is formed using a metal magnetic material, and a coil is formed inside or on a surface of the component body, wherein the metal magnetic material comprises a metal magnetic alloy powder consisting of iron and silicon or containing iron, silicon and chromium, and an additional element added to the metal magnetic alloy powder, wherein the additional element is more easily oxidizable in an equilibrium state of oxidation-reduction reaction than the elements contained in the metal magnetic alloy powder; and wherein the component body internally includes a reaction product of the metal magnetic alloy powder and the additional element which is more easily oxidizable in an equilibrium state of oxidation-reduction reaction than the elements contained in the metal magnetic alloy powder. This makes it possible to allow an electric component to have low loss and good DC superimposition characteristics.

BRIEF DESCRIPTION OF DRAWINGS

FIG. 3 is a table collectively presenting respective compositions of Examples 1 to 4 and Comparative Examples 1 to 5 subjected to a comparative test and a result of the comparative test.

FIG. 6 is a table collectively presenting respective compositions of Examples 5 to 11 and Comparative Examples 1 and 6 to 8 subjected to another comparative test and a result of the comparative test.

FIGS. 8(A) and 8(B) are photographs presenting an oxygen distribution in a cut surface of a metal magnetic material in Example 9.

DESCRIPTION OF EMBODIMENTS

Figure 1:
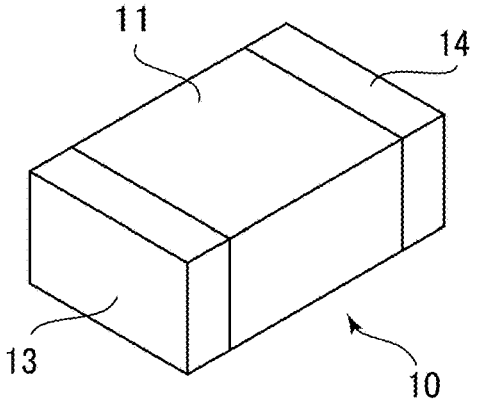
FIG. 1 is a perspective view depicting an electronic component according to one embodiment of the present invention.

According to one embodiment of the present invention, there is provided a metal magnetic material which comprises a metal magnetic alloy powder consisting of iron and silicon or containing iron, silicon and chromium, and an additional element added to the metal magnetic alloy powder, wherein the additional element is more easily oxidizable in an equilibrium state of oxidation-reduction reaction than the elements contained in the metal magnetic alloy powder. Lithium may be used as the additional element which is more easily oxidizable in an equilibrium state of oxidation-reduction reaction than the elements contained in the metal magnetic alloy powder. When the metal magnetic material is subjected to a heat treatment, a reaction product of at least one of the elements of the metal magnetic alloy powder and lithium as the additional element which is more easily oxidizable in an equilibrium state of oxidation-reduction reaction than the elements contained in the metal magnetic alloy powder. The reaction product is present in the form of an oxide of at least one of the elements of the metal magnetic alloy powder and the additional element, in a vicinity of surfaces of particles of the metal magnetic alloy powder.

Thus, in one embodiment of the present invention, types of and an amount of elements comprised in the metal magnetic material are adjusted by adding the additional element which is more easily oxidizable in an equilibrium state of oxidation-reduction reaction than the elements contained in the metal magnetic alloy powder, so that it becomes possible to produce a substance which does not originate from a raw material composition of the metal magnetic alloy powder, and thus effectively establish insulation, as compared to the conventional technique of forming an insulating film made of an oxide originating from only a raw material composition of particles of a metal magnetic material, on each of the particles. Lithium is capable of reacting with iron constituting the metal magnetic alloy powder to form a reaction product with iron in the vicinity of the surface of the metal magnetic alloy powder.

According to another embodiment of the present invention, there is provided an electric component which comprises a component body formed using a metal magnetic material comprising: a metal magnetic alloy powder consisting of iron and silicon or containing iron, silicon and chromium; and an additional element added to the metal magnetic alloy powder, wherein the additional element is more easily oxidizable in an equilibrium state of oxidation-reduction reaction than the elements contained in the metal magnetic alloy powder. Lithium may be used as the additional element which is more easily oxidizable in an equilibrium state of oxidation-reduction reaction than the elements contained in the metal magnetic alloy powder. When the component body is subjected to a heat treatment, a reaction product of at least one of the elements of the metal magnetic alloy powder and lithium as the additional element which is more easily oxidizable in an equilibrium state of oxidation-reduction reaction than the elements contained in the metal magnetic alloy powder. The reaction product is present in the form of an oxide of at least one of the elements of the metal magnetic alloy powder and the additional element, in the vicinity of surfaces of particles of the metal magnetic alloy powder. A coil is formed inside or on a surface of the component body.

Thus, in another embodiment of the present invention, types of and an amount of elements comprised in the metal magnetic material are adjusted by adding the additional element which is more easily oxidizable in an equilibrium state of oxidation-reduction reaction than the elements contained in the metal magnetic alloy powder, so that it becomes possible to produce a substance which does not originate from a raw material composition of the metal magnetic alloy powder, and thus effectively insulate between particles of the metal magnetic alloy powder, and strongly bind the particles of the metal magnetic alloy powder together, as compared to the conventional technique of forming an insulating film made of an oxide originating from only a raw material composition of particles of a metal magnetic material, on each of the particles. Lithium is capable of reacting with iron constituting the metal magnetic alloy powder to form a reaction product with iron in the vicinity of the surface of the metal magnetic alloy powder, and strongly binding the particles of the metal magnetic alloy powder together through the reaction product.

With reference to the drawings, a preferred embodiment of the present invention will be described below.

Figure 2:
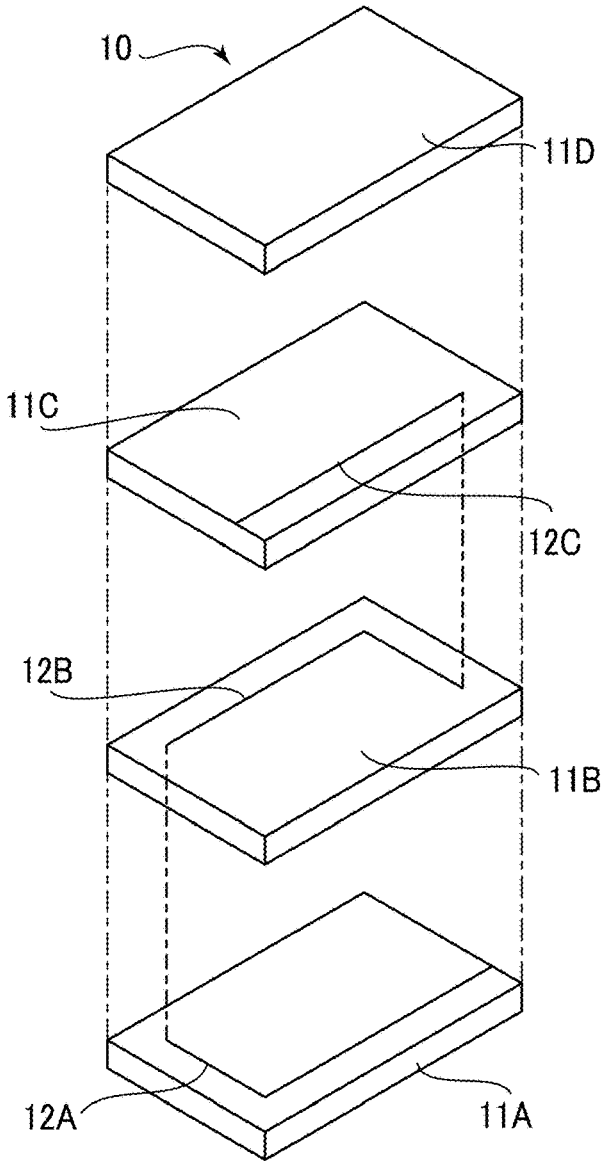
FIG. 2 is an exploded perspective view of the electronic component in FIG. 1.

FIG. 1 is a perspective view depicting an electronic component according to one embodiment of the present invention, and FIG. 2 is an exploded perspective view of the electronic component in FIG. 1.

In FIGS. 1 and 2, the reference sign 10 indicates an electrical component. The reference sign 11 indicates a component body, and each of the reference signs 13 and 14 indicates an external terminal.

The electronic component 10 is a laminated inductor comprising the component body 11 and the two external terminals 13, 14.

The component body 11 comprises a plurality of metal magnetic layers 11A, 11B, 11C, 11D, and a plurality of coil conductor patterns 12A, 12B, 12C.

Each of the metal magnetic layers 11A, 11B, 11C, 11D is formed of a metal magnetic material comprising a metal magnetic alloy powder and an additional element added to the metal magnetic alloy powder, wherein the additional element is more easily oxidizable in an equilibrium state of oxidation-reduction reaction than an element contained in the metal magnetic alloy powder.

The metal magnetic alloy powder is composed of a powder of a metal magnetic alloy consisting of iron and silicon (i.e., Fe—Si based metal magnetic alloy) or a metal magnetic alloy containing iron, silicon and chromium (i.e., Fe—Si—Cr based metal magnetic alloy). In this embodiment, lithium is used as the additional element which is more easily oxidizable in an equilibrium state of oxidation-reduction reaction than the elements contained in the metal magnetic alloy powder. In the component body 11 (metal magnetic layers 11A, 11B, 11C, 11D), a reaction product of iron as one of the elements of the metal magnetic alloy powder and lithium as the additional element is formed in the form of an oxide of the elements of the metal magnetic alloy, in a vicinity of surfaces of particles of the metal magnetic alloy. Further, the particles of the metal magnetic alloy powder in the component body 11 are bound together through the reaction product of iron constituting the metal magnetic alloy powder and lithium as the additional element. Details of the metal magnetic alloy powder forming the metal magnetic layers 11A, 11B, 11C, 11D will be described later.

Each of the coil conductor patterns 12A, 12B, 12C is formed using a conductive paste obtained by forming a metal material, such as silver, a silver-based alloy, gold, a gold-based alloy, copper or a copper-based alloy, into paste form.

The coil conductor pattern 12A is formed on a surface of the metal magnetic layer 11A. The coil conductor pattern 12A is formed in a shape corresponding to less than one coil turn. One end of the coil conductor pattern 12A is led to one edge face of the metal magnetic layer 11A.

The coil conductor pattern 12B is formed on a surface of the metal magnetic layer 11B. The coil conductor pattern 12B is formed in a shape corresponding to less than one coil turn. One end of the coil conductor pattern 12B is connected to the other end of the coil conductor pattern 12A via a conductor in a through-hole of the coil conductor pattern 12B.

The coil conductor pattern 12C is formed on a surface of the metal magnetic layer 11C. The coil conductor pattern 12C is formed in a shape corresponding to less than one coil turn. One end of the coil conductor pattern 12C is connected to the other end of the coil conductor pattern 12B via a conductor in a through-hole of the coil conductor pattern 12C. Further, the other end of the coil conductor pattern 12C is led to one edge face of the metal magnetic layer 11C.

The metal magnetic layer 11D is laminated on the metal magnetic layer 11C formed with the coil conductor pattern 12C, to thereby protect the coil conductor patterns.

In this manner, a coil pattern is formed within the component body 11 by the coil conductor patterns 12A to 12C between adjacent ones of the metal magnetic layers. The external terminals 13, 14 are formed, respectively, on the opposite edge faces of the component body 11, as depicted in FIG. 2. The one end of the coil conductor pattern 12A is connected to the external terminal 14, and the other end of the coil conductor pattern 12C is connected to the external terminal 13, so that the coil pattern is connected between the external terminal 13 and the external terminal 14.

The electronic component having the above configuration, according to this embodiment, may be produced as follows.

First of all, a given amount of lithium is added to and mixed with a Fe—Si alloy or Fe—Si—Cr alloy powder having a given composition, and then a binder such as PVA (polyvinyl alcohol) is further added thereto. Then, the resulting mixture is kneaded into a paste to obtain a metal magnetic material paste. Separately, a conductive paste for forming the coil conductor patterns 12A, 12B, 12C is prepared. The metal magnetic material paste and the conductive paste are alternately screen-printed to form layers to thereby obtain an untreated component body. The obtained shaped body is subjected to a binder removing treatment in an ambient atmosphere at a given temperature, and then a heat treatment to obtain an electronic component 10. The external terminals 13, 14 may be formed after the heat treatment. In this case, the conductive paste for the external terminals may be applied to opposite edge faces of the component body 11 after the heat treatment, and then subjected to heating to provide the external terminals 13, 14. Alternatively, the external terminals 13, 14 may be provided by: applying the conductive paste for the external terminals to opposite edge faces of the component body 11 after the heat treatment; then subjecting the conductive paste to baking; and subjecting the resulting conductors baked on the component body 11 to plating. In this case, with a view to preventing a plating solution from entering a void existing inside the component body 11, the component body 11 may be impregnated with a resin to fill the void with the resin.

In this embodiment, as the metal magnetic material for use in the metal magnetic layers 11A, 11B, 11C, 11D for forming the component body 11, a mixture obtained by adding lithium to the metal magnetic alloy powder is used to satisfy both of magnetic properties and insulating performance. Specific examples of the metal magnetic material will be described below with reference to a result of comparative test on examples including Comparative Examples.

FIG. 3 is a table collectively presenting respective compositions of Examples 1 to 4 and Comparative Examples 1 to 5 subjected to a comparative test and a result of the comparative test, in the case where the metal magnetic alloy powder contains iron, silicon and chromium.

In this comparative test, an inductor was formed by: adding lithium to a Fe—Cr—Si alloy powder having a given composition, in a given amount represented in $Li_2O_3$ equivalent in FIG. 3; mixing them; further adding a binder such as PVA (polyvinyl alcohol) thereto; kneading the resulting mixture to obtain a metal magnetic material paste; forming an untreated component body (shaped body) using the metal magnetic material paste; and subjecting the shaped body to a binder removing (defatting) treatment in an ambient atmosphere at 400 to 600° C. and then a heat treatment in an ambient atmosphere at 800° C. Although the Fe—Cr—Si alloy powder can be produced by various powderization process including: an atomization process such as a water atomization process or a gas atomization process; a reduction process; a carbonyl process; and a pulverization process, Fe—Cr—Si alloy particles whose surfaces are not subjected to a treatment for forming a metal oxide thereon are used in the comparative test. That is, Fe—Cr—Si alloy particles whose surfaces are not subjected to a special treatment are directly used as the Fe—Cr—Si alloy powder.

The metal magnetic materials in Examples 1 to 4 were prepared by adding lithium to the metal magnetic alloy powder in an amount of less than 5 wt %. As a result, as compared to the case without the addition (Comparative Example 1), the insulation resistance increases, and the three-point bending strength also increases.

Further, by adding lithium to the metal magnetic alloy powder in an amount of less than 1 wt %, magnetic properties such as the complex permeability μ' could be ensured at a level equal to that in the case without the addition (Comparative Example 1).

In the metal magnetic material where lithium was added to the metal magnetic alloy powder in an amount of 10 wt %, the resistivity was lowered due to generation of a different phase ($Fe_3O_4$) or the like, and thereby the permeability at 10 MHz is significantly lowered.

When, in the comparative test, the lowering of the complex permeability μ' at 10 MHz with respect to the case without the addition is within 30%, and the volume resistivity and the three-point bending strength are, respectively, $10^7$ Ω·cm or more and 40 MPa or more, the metal magnetic material was evaluate as "OK (○)", and, when this condition was not satisfied, the metal magnetic material was evaluate as "NG (×)". A result of evaluation is presented in FIG. 3. This condition is set as a minimum condition for a metal magnetic material usable in a conductor. All of the metal magnetic materials in Examples 1 to 4 satisfy this condition, and were evaluated as "OK (○)". This result shows that, for satisfying the above condition, it is necessary to add lithium in an amount of greater than 0 wt % to less than 1 wt %, preferably, 0.1 wt % to 0.5 wt %.

A fact that $LiFe_5O_8$ is produced on surfaces of particles of the Fe—Cr—Si alloy powder as a result of the addition of lithium can be ascertained by X-ray diffraction or ESM-EDX.

Figure 4:
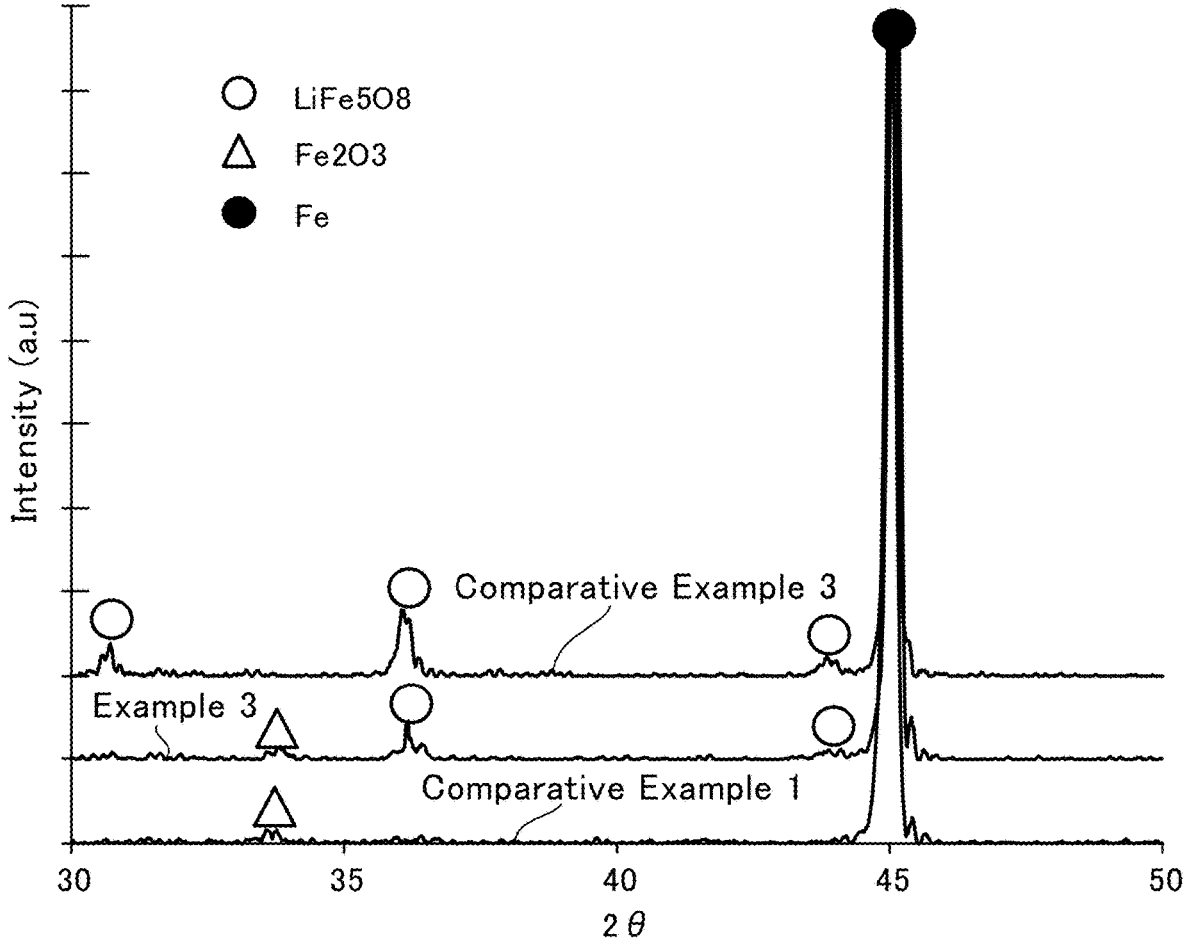
FIG. 4 is an X-ray diffraction chart of Example 3 and Comparative Examples 1 and 3.

FIG. 4 is an X-ray diffraction chart presenting a result of X-ray diffraction analyses on a sample of the metal magnetic material in Comparative Example 1 without the addition of lithium, a sample of the metal magnetic material in Example 3, and a sample of the metal magnetic material in Comparative Example 3. In FIG. 4, reference positions of three types of lines in the vertical axis (strength) are offset from each other to avoid overlapping of the lines.

According to the result, in the samples of the metal magnetic material in Example 3 and the metal magnetic material in Comparative Example 3, peaks of $LiFe_5O_8$ can be observed when 20 is in the range of 30 to 50. In Comparative Example 1 without the addition of lithium, no peak of $LiFe_5O_8$ is observed, and, instead, a peak of $Fe_2O_3$, i.e., an oxide of only a raw material composition of particles of the metal magnetic alloy powder, is observed.

Further, in the rage where no different phase is produced, the diffraction peak of $LiFe_5O_8$ tends to become larger along with an increase of the addition amount of lithium. Therefore, the diffraction peak of $LiFe_5O_8$ in the sample of the metal magnetic material in Comparative Example 3 is larger than that in the sample of the metal magnetic material in Example 3.

Figure 5:
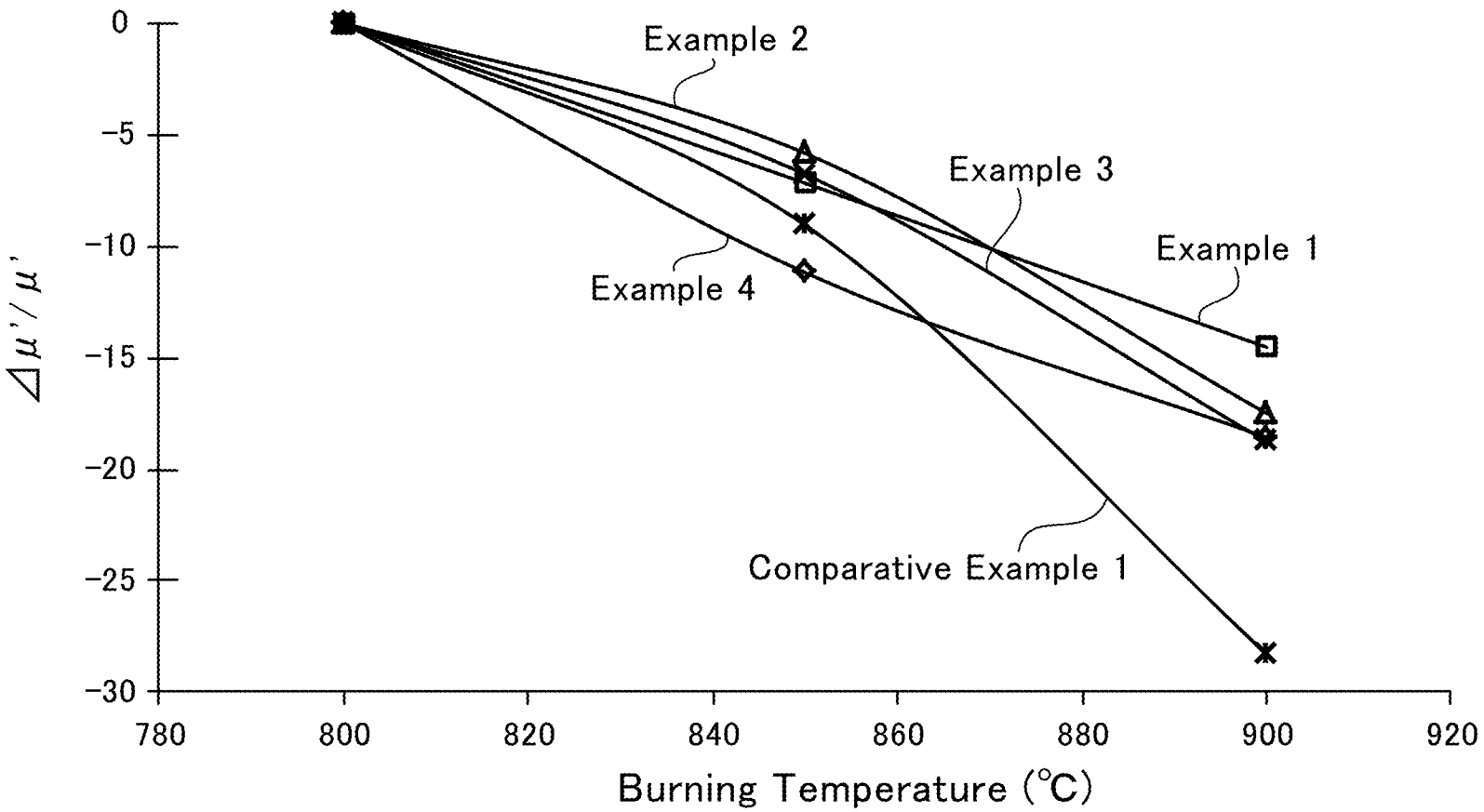
FIG. 5 is a graph depicting a result obtained by measuring respective permeabilities of Examples 1 to 4 and Comparative Example 1 while changing a heat treatment temperature.

Further, as for Examples 1 to 4 and Comparative Example 1 without the addition of lithium, the permeability property was ascertained while changing a heat treatment temperature. As depicted in FIG. 5, checking a change rate of permeability on the basis of a permeability at 800° C. while gradually increasing the heat treatment temperature, all of Examples 1 to 4 can maintain the permeability until the heat treatment temperature reaches a higher value, as compared to Comparative Example 1. As long as the metal magnetic material can maintain the permeability property at a heat treatment temperature of 850° C. or more, even in the case where it is applied, for example, to a laminated inductor having a conductor pattern made of silver, it is possible to satisfy both of a reduction in resistance and ensuring of properties (inductance value, etc.) of the conductor pattern. In Comparative Example 1 without the addition of lithium, the permeability is significantly lowered when the heat treatment temperature is increased to a given value. Thus, the heat treatment temperature cannot be set to a sufficiently high value, and thereby the resistance of the conductor pattern cannot be sufficiently reduced. Differently, Examples 1 to 4 can maintain the permeability even when the heat treatment temperature is increased to a value close to a melting point of silver as a conductor pattern, so that it becomes possible to satisfy both of a reduction in resistance and ensuring of properties (inductance value, etc.) of thee conductor pattern, and thus obtain a laminated inductor having high electric properties.

It should be noted that the addition of lithium does not always provide good result, as in Comparative Examples 2 to 5. Thus, when the metal magnetic material in each of Examples 1 to 4 with the addition of lithium is used, the addition amount of lithium may be set to an optimal value depending on a particle size of the metal magnetic material and the heat treatment temperature. In this regard, as the particle size of the metal magnetic alloy powder becomes larger, a required amount of lithium becomes smaller (because a surface area of the particles of the metal magnetic alloy powder becomes smaller). Further, when the heat treatment temperature is set to a higher value, it is also desirable to adjust the addition amount of lithium.

FIG. 6 is a table collectively presenting respective compositions of Examples 5 to 11 and Comparative Examples 1 and 6 to 8 subjected to a comparative test and a result of the comparative test, in the case where the metal magnetic alloy powder consists of iron and silicon.

In this comparative test, an inductor was formed by: adding lithium to a Fe—Si alloy powder having a given composition, in a given amount represented in $Li_2O_3$ equivalent in FIG. 6; mixing them; further adding a binder such as PVA (polyvinyl alcohol) thereto; kneading the resulting mixture to obtain a metal magnetic material paste; forming an untreated component body (shaped body) using the metal magnetic material paste in such a manner that the shaped body has a density of 5.7 g/cm$^3$; and subjecting the shaped body to a binder removing (defatting) treatment in an ambient atmosphere at 400 to 600° C. and then a heat treatment in an ambient atmosphere at 750° C. Although the Fe—Si alloy powder can be produced by various powderization process including: an atomization process such as a water atomization process or a gas atomization process; a reduction process; a carbonyl process; and a pulverization process, Fe—Si alloy particles whose surfaces are not subjected to a treatment for forming a metal oxide thereon are used in the comparative test. That is, Fe—Si alloy particles whose surfaces are not subjected to a special treatment are directly used as the Fe—Si alloy powder.

In the metal magnetic material without the addition of lithium to the Fe—Si alloy powder (Comparative Example 6), the permeability at 10 MHz was poor although the insulation resistance and the strength were sufficiently high. Similarly, in the metal magnetic material without the addition of lithium to the Fe—Cr—Si alloy powder (Comparative Example 1), the insulation resistance, the withstand voltage and the three-point bending strength were poor although the permeability at 10 MHz was sufficiently high. In contrast, the metal magnetic materials in Examples 5 to 11 were prepared by adding lithium to the metal magnetic alloy powder in an amount of less than 3 wt %. As a result, as compared to Comparative Examples 1 and 2, the three-point bending strength increases. In addition, by adding lithium to the metal magnetic alloy powder in an amount of less than 3 wt %, magnetic properties such as the complex permeability μ' at 10 MHz was improved, as compared to the metal magnetic material without the addition of lithium to the Fe—Si alloy powder (Comparative Example 6). Further, by adding lithium to the metal magnetic alloy powder in an amount of less than 3 wt %, the metal magnetic materials in Examples 5 to 11 are also improved in terms of the insulation resistance and the withstand voltage, as compared to the metal magnetic material without the addition of lithium to the Fe—Cr—Si alloy powder (Comparative Example 1).

In the metal magnetic material where lithium was added to the metal magnetic alloy powder in an amount of 3 wt % or more, the resistivity was lowered due to generation of a different phase ($Fe_3O_4$) or the like, and thereby the permeability at 10 MHz is significantly lowered.

When, in the comparative test, the lowering of the complex permeability μ' at 10 MHz with respect to the case without the addition of lithium to the Fe—Cr—Si alloy powder (Comparative Example 1) is within 30%, and the volume resistivity and the three-point bending strength are, respectively, $10^7$ Ω·cm or more and 40 MPa or more, the metal magnetic material was evaluate as "OK (○)", and, when this condition was not satisfied, the metal magnetic material was evaluate as "NG (×)". A result of the evaluation is presented in the column "Evaluation" in FIG. 6. This condition is set as a minimum condition for a metal magnetic material usable in a conductor. All of the metal magnetic materials in Examples 5 to 11 satisfy this condition, and were evaluated as "OK (○)". This result shows that, for satisfying the above condition, it is necessary to add lithium in an amount of greater than 0 wt % to less than 3 wt %, preferably, 0.3 wt % to 2 wt %.

A fact that $LiFe_5O_8$ is produced on surfaces of particles of the Fe—Si alloy powder as a result of the addition of lithium can be ascertained by X-ray diffraction or ESM-EDX.

Figure 7:
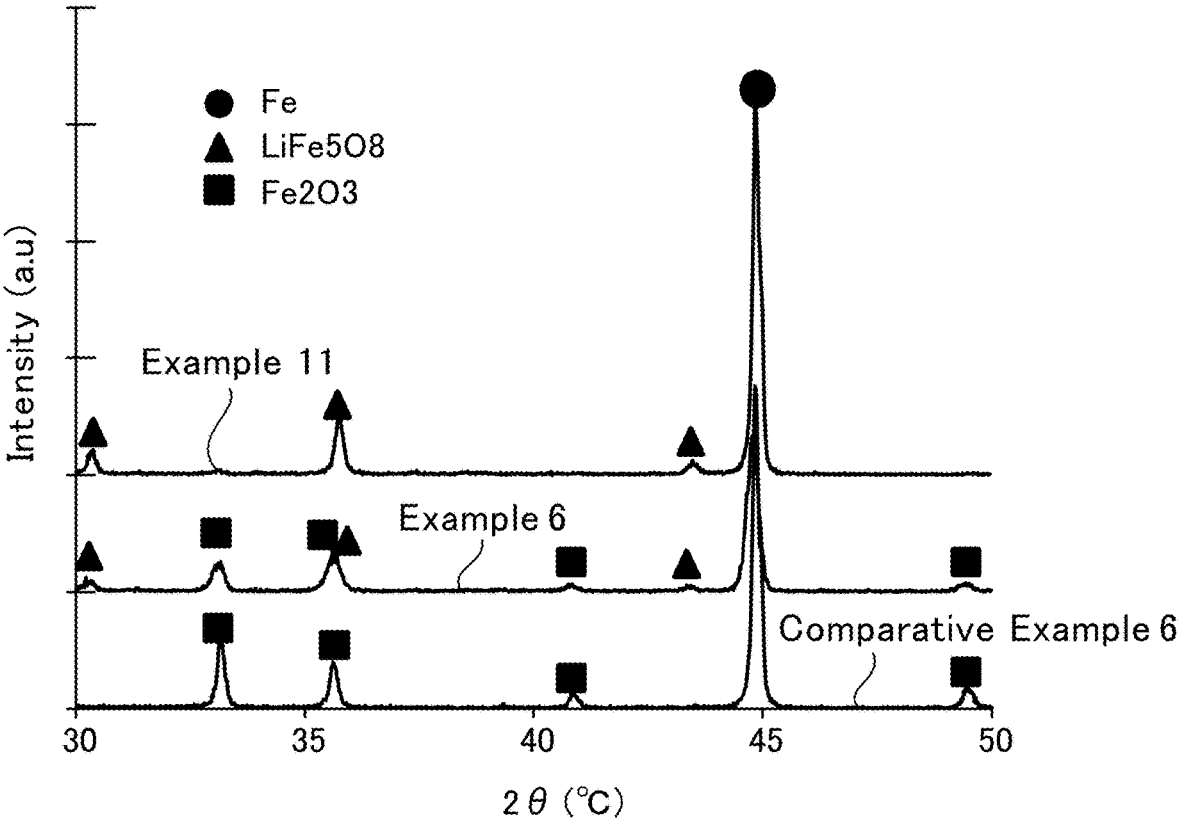
FIG. 7 is an X-ray diffraction chart of Examples 6 and 11 and Comparative Example 6.

FIG. 7 is an X-ray diffraction chart presenting a result of X-ray diffraction analyses on a sample of the metal magnetic material in Comparative Example 6 without the addition of lithium to the Fe—Si alloy powder, a sample of the metal magnetic material in Example 6, and a sample of the metal magnetic material in Example 11. In FIG. 7, reference positions of three types of lines in the vertical axis (strength) are offset from each other to avoid overlapping of the lines.

According to the result, in the samples of the metal magnetic material in Example 6 and the metal magnetic material in Example 11, peaks of $LiFe_5O_8$ can be observed when 20 is in the range of 30 to 50. In Comparative Example 6 without the addition of lithium to the Fe—Si alloy powder, no peak of $LiFe_5O_8$ is observed, and, instead, peaks of $Fe_2O_3$, i.e., an oxide of only a raw material composition of particles of the metal magnetic alloy powder, are observed.

Further, in the rage where no different phase is produced, the diffraction peak of $LiFe_5O_8$ tends to become larger along with an increase of the addition amount of lithium. Therefore, the diffraction peak of $LiFe_5O_8$, i.e., an amount of formation of $LiFe_5O_8$, in the sample of the metal magnetic material in Example 11 is larger than that in the sample of the metal magnetic material in Example 5. In Example 6, in addition to $LiFe_5O_8$, a very small amount of formation of $Fe_2O_3$ is ascertained. In this situation, it should be understood that, as long as a large part of the reaction product of the metal magnetic alloy powder and the additional element which is more easily oxidizable in an equilibrium state of oxidation-reduction reaction than the elements contained in the metal magnetic alloy powder is $LiFe_5O_8$, the same effect can be obtained even if an oxide of at least one of the elements of the metal magnetic alloy powder is present together with the $LiFe_5O_8$.

FIGS. 8(A) and 8(B) are SEM-WDX photographs presenting an oxygen distribution in a cut surface of a sample of the metal magnetic material in Example 9. As seen in FIGS. 8(A) and 8(B), oxygen elements are detected on surfaces of particles of the metal magnetic alloy powder, i.e., an oxygen-containing phase formed on surfaces of the particles of the metal magnetic alloy powder is observed. This oxygen-containing phase is considered to satisfy both high insulation resistance and high three-point strength.

Figure 9:
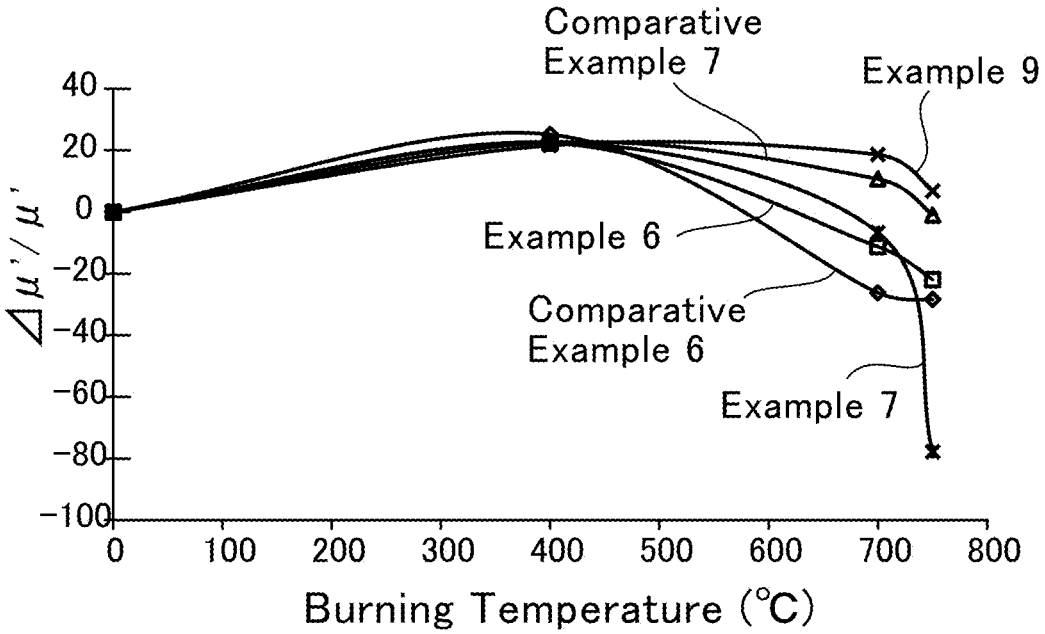
FIG. 9 is a graph depicting a result obtained by measuring respective permeabilities of Examples 6, 7 and 9 and Comparative Examples 6 and 7 while changing a heat treatment temperature.

Further, as for Examples 6, 7 and 9, Comparative Example 7, and Comparative Example 6 without the addition of lithium to the Fe—Si alloy powder, the permeability property was ascertained while changing a heat treatment temperature. As depicted in FIG. 9, checking a change rate of permeability on the basis of a permeability at the time of the shaping while gradually increasing the heat treatment temperature, all of Examples 6, 7 and 9 can maintain the permeability until the heat treatment temperature reaches a higher value, as compared to Comparative Example 6. As long as the metal magnetic material can maintain the permeability property at a heat treatment temperature of 700° C. or more, even in the case where it is applied, for example, to a laminated inductor having a conductor pattern made of silver, it is possible to satisfy both of a reduction in resistance and ensuring of properties (inductance value, etc.) of the conductor pattern. In Comparative Example 6 without the addition of lithium, the permeability is significantly lowered when the heat treatment temperature is increased to a given value. Thus, the heat treatment temperature cannot be set to a sufficiently high value, and thereby the resistance of the conductor pattern cannot be sufficiently reduced. In the metal magnetic material without the addition of lithium to the Fe—Cr—Si alloy powder (Comparative Example 1), the permeability is relatively high and thereby a high inductance value can be ensured. However, the three-point bending strength is poor, thereby possibly leading to poor product strength or difficulty in obtaining required strength when use in a small-size and low-profile component. Moreover, the withstand voltage is poor, thereby leading to difficulty in applying to a booster circuit or the like. Differently, Examples 6, 7 and 9 can maintain the permeability even when the heat treatment temperature is increased to a value close to a melting point of silver as a conductor pattern, and can exhibit high strength, insulation resistance and withstand voltage, so that it becomes possible to ensure high inductance value, low resistance and high withstand voltage, and thus obtain a laminated inductor having high electric properties and reliability.

It should be noted that the addition of lithium does not always provide good result, as in Comparative Examples 7 and 8. Thus, when the metal magnetic material in each of Examples 7 and 8 with the addition of lithium is used, the addition amount of lithium may be set to an optimal value depending on a particle size of the metal magnetic material and the heat treatment temperature. In this regard, as the particle size of the metal magnetic alloy powder becomes larger, a required amount of lithium becomes smaller (because a surface area of the particles of the metal magnetic alloy powder becomes smaller). Further, when the heat treatment temperature is set to a higher value, it is also desirable to adjust the addition amount of lithium.

It is to be understood that the present invention is not limited to the above embodiment, but various changes and modifications will be apparent to those skilled in the art. Therefore, unless otherwise such changes and modifications depart from the scope of the present invention hereinafter defined, they should be construed as being included therein.

(1) Although the above embodiment has been described based on a specific example of the heat treatment temperature, the heat treatment temperature is not limited thereto, but may be appropriately changed depending on the particle size of the metal magnetic material, desired magnetic properties or the like.

(2) The above embodiment has been described based on an example where the additive to be added to the metal magnetic material is lithium. However, the additive is not limited thereto, but may be changed to various elements, as long as they are more easily oxidizable in an equilibrium state of oxidation-reduction reaction than the elements contained in the metal magnetic alloy powder, and are capable of reacting with the metal magnetic alloy powder during burning to form a reaction product.

(3) The amount of the additive to be added to the metal magnetic material, described in the above embodiment, may be appropriately changed depending on the particle size of the metal magnetic material, desired magnetic properties or the like.

(4) The above embodiment has been described on an assumption that no oxide is formed on surfaces of particles of the metal magnetic alloy powder comprised in the metal magnetic material. However, the present invention is not limited thereto, but an oxide may be formed on the surfaces of the particles of the metal magnetic alloy powder. In the metal magnetic alloy powder, oxidation progresses spontaneously or during a high-temperature heat treatment, and a metal oxide originating from only the metal magnetic alloy powder can be spontaneously formed on a part or an entirety of the surface thereof. In the present invention, insulating performance based on such a metal oxide originating from only the metal magnetic alloy powder is not expected. However, there is no problem even if such a metal oxide is formed on the surfaces of the particles of the metal magnetic alloy powder.

(5) Although the above embodiment has been described based on an example where adjacent particles of the metal magnetic alloy powder contained in the component body are bound together through the reaction product of the metal magnetic alloy powder and lithium, particles of the metal magnetic alloy powder may be mutually bound together in a region where the reaction product of lithium and the metal magnetic alloy powder is not present, in addition to being bound together through the reaction product of lithium and the metal magnetic alloy powder.

(6) The component body may be formed as a drum-shaped or H-shaped core, wherein a coil may be wound around an outer periphery of the core.

The above embodiment and each of the modified embodiments may be appropriately used in combination, but detailed description thereof will be omitted. It should be noted that the present invention is not limited to the aforementioned embodiments.

LIST OF REFERENCE SIGNS

10: electronic component
11: component body
11A, 11B, 11C, 11D: metal magnetic layer
12A, 12B, 12C: coil conductor pattern
13, 14: external terminal

The invention claimed is:

1. An electric component comprising: a component body formed using a metal magnetic material; and a coil formed inside or on a surface of the component body, wherein the metal magnetic material comprises a metal magnetic alloy powder containing iron and silicon, and an additional element added to the metal magnetic alloy powder, the additional element being more easily oxidizable in an equilibrium state of oxidation-reduction reaction than the elements contained in the metal magnetic alloy powder, wherein in the component body and in a vicinity of surfaces of particles of the metal magnetic alloy powder, a reaction product of the metal magnetic alloy powder and the additional element which is more easily oxidizable in an equilibrium state of oxidation-reduction reaction than the elements contained in the metal magnetic alloy powder is deposited, and adjacent particles of the metal magnetic alloy powder are bound together through the reaction product, wherein the additional element is lithium, wherein the reaction product comprises $LiFe_5O_8$, and wherein the component body does not contain glass.

2. The electric component as recited in claim 1, wherein the metal magnetic alloy powder further contains chromium.

3. The electric component as recited in claim 2, wherein the component body has a volume resistivity of $10^7\Omega\cdot$cm or more.

4. The electric component as recited in claim 2, wherein the adjacent particles of the metal magnetic alloy powder are also mutually bound together.

5. The electric component as recited in claim 4, wherein the component body has a volume resistivity of $10^7\Omega\cdot$cm or more.

6. The electric component as recited in claim 1, wherein the metal magnetic alloy powder consists of iron and silicon.

7. The electric component as recited in claim 6, wherein the component body has a volume resistivity of $10^7\Omega\cdot$cm or more.

8. The electric component as recited in claim 6, wherein the adjacent particles of the metal magnetic alloy powder are also mutually bound together.

9. The electric component as recited in claim 8, wherein the component body has a volume resistivity of 107Ω·cm or more.

10. The electric component as recited in claim 1, wherein the adjacent particles of the metal magnetic alloy powder are also mutually bound together.

11. The electric component as recited in claim 10, wherein the component body has a volume resistivity of $10^7\Omega\cdot$cm or more.

12. The electric component as recited in claim 1, wherein the component body has a volume resistivity of $10^7\Omega\cdot$cm or more.

* * * * *